US007182662B2

(12) United States Patent
O'Meara et al.

(10) Patent No.: US 7,182,662 B2
(45) Date of Patent: Feb. 27, 2007

(54) HYBRID PERSONAL FLOTATION DEVICE

(75) Inventors: Stephen J. O'Meara, Arcata, CA (US); Adam Knoeller, Arcata, GA (US); Rene'e Thompson, Arcata, CA (US); Penny Holt, Aracata, CA (US); Eric Campbell, Arcata, CA (US)

(73) Assignee: Kokatat. Inc., Arcata, CA (US)

( * ) Notice: Subject to any disclaimer, the term of this patent is extended or adjusted under 35 U.S.C. 154(b) by 15 days.

(21) Appl. No.: 11/206,690

(22) Filed: Aug. 18, 2005

(65) Prior Publication Data

US 2006/0040574 A1 Feb. 23, 2006

Related U.S. Application Data

(60) Provisional application No. 60/602,903, filed on Aug. 18, 2004.

(51) Int. Cl.
*B63C 9/28* (2006.01)

(52) U.S. Cl. ..... 441/111; 441/115

(58) Field of Classification Search ..... 441/102, 441/103, 111, 112, 115, 116, 117, 118
See application file for complete search history.

(56) References Cited

U.S. PATENT DOCUMENTS 728,745 A * 5/1903 Morrison ..... 441/115
928,465 A * 7/1909 Krieger et al. ..... 441/115
4,533,335 A * 8/1985 Hoshino ..... 441/102
4,673,366 A * 6/1987 Hawkins ..... 441/90
5,603,646 A * 2/1997 Tobias ..... 441/94
5,759,076 A * 6/1998 Bateman et al. ..... 441/115
5,820,432 A * 10/1998 Wright ..... 441/119
5,823,839 A * 10/1998 Khanamirian ..... 441/106
6,379,208 B2 * 4/2002 Khanamirian ..... 441/106
2004/0033739 A1 2/2004 Courtney

* cited by examiner

*Primary Examiner*—Stephen Avila
(74) *Attorney, Agent, or Firm*—Craig M. Stainbrook; Stainbrook & Stainbrook, LLP

(57) ABSTRACT

A hybrid personal flotation device includes a flotation vest body having a front, back, shoulder straps, and adjustable buckle straps. An expandable cover over at least a portion of the vest body covers an inflatable chamber having a front chamber portion connected to a back chamber portion by a single shoulder pass-through. Inflation of the inflatable chamber is accomplished by an oral inflation tube and/or a manually activated cylinder containing compressed CO2. The low-profile, narrow single shoulder pass-through permits fluid communication for both inflation and deflation between the front and back chamber portions, but does not restrict the wearer's neck or shoulder range of motion. The inflatable front and back chamber portions remain covered when fully inflated, and require no folding or re-packing when deflated.

10 Claims, 4 Drawing Sheets

HYBRID PERSONAL FLOTATION DEVICE

CROSS REFERENCE TO RELATED APPLICATIONS

This application claims the benefit of U.S. Provisional Patent Application Ser. No. 60/602,903, filed 18 Aug. 2004.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to water safety equipment, life vests, and personal flotation devices (PFDs), and more particularly to an improved hybrid personal flotation device.

BACKGROUND INFORMATION AND DISCUSSION OF RELATED ART

Water safety equipment in the form of life vests and personal flotation devices (PFDs) are well known and in widespread use. However, existing U.S. Coast Guard approved inflatable PFDs and hybrid inflatable PFDs (those with some inherent buoyancy) are hindered by two significant problems. First, all known existing approved devices of this type use a yoke style inflatable chamber that surrounds the wearer's neck area which makes the device cumbersome and uncomfortable to wear, and virtually impossible for the wearer to swim in when inflated. Additionally, these known approved devices must be folded and/or re-packed after full inflation in order to be returned to their original wearable configuration.

United States Patent Application Publication No. 20040033739 discloses a multi-chambered personal survival device and an orally inflated, flush mounted, hybrid bladder configured, supported and protected by the external fabric shell of the underlying inherently buoyant PFD. The fabric shell of the foam PFD can be extended and cut to distribute and allocate the orally inflated buoyant moments to augment the buoyancy deficits of the specific underlying foam PFD design in order to create improved corrective turning, head angle, mandibular support and freeboard. The fabric shell while shaping the bladder, bears the strain of the oversized inflated bladder protecting the bladder film and seams from rupture. The internal orally inflated hybrid bladder is protected by the external fabric shell and or foam layer from UV radiation, abrasion and puncture allowing use of films or thin films as well as UL approved fabric supported laminates for construction of the hybrid bladder. An expiratory pump converts the released bladder into a self-bailing life raft.

The foregoing patent application and prior art discussion reflects the current state of the art of which the present inventor is aware. Reference to, and discussion of, this information is intended to aid in discharging Applicant's acknowledged duty of candor in disclosing information that may be relevant to the examination of claims to the present invention. However, it is respectfully submitted that none of the above-indicated references disclose, teach, suggest, show, or otherwise render obvious, either singly or when considered in combination, the invention described and claimed herein.

BRIEF SUMMARY OF THE INVENTION

The hybrid personal flotation device of this invention includes a more or less traditional flotation vest body having a front, back, shoulder straps, and adjustable buckle straps. An expandable cover over at least a portion of the vest body covers an inflatable chamber having a front chamber portion connected to a back chamber portion by a single shoulder pass-through. Inflation of the inflatable chamber is accomplished by an oral inflation tube and/or a manually activated cylinder containing compressed CO2. The low-profile, narrow single shoulder pass-through permits fluid communication for both inflation and deflation between the front and back chamber portions, but does not restrict the wearer's neck or shoulder range of motion.

Inherent buoyancy for the inventive device is provided by foam inserts, while inflatable buoyancy is provided by inflation of the inflatable chambers. The distinct front and back inflatable chamber portions are connected by a single minimal volume, low-profile pass-through that can be activated by a single inflation device. The inflatable front and back chamber portions remain covered when fully inflated, and yet require no folding or re-packing when deflated.

The improved hybrid inflatable personal flotation device of this invention is particularly well suited as a recreational hybrid inflatable life vest for adult wearers weighing more than 90 lbs.

It is therefore an object of the present invention to provide a new and improved life vest or personal flotation device.

It is another object of the present invention to provide a new and improved hybrid inflatable personal flotation device.

A further object or feature of the present invention is a new and improved personal flotation device with improved comfort and wearability.

An even further object of the present invention is to provide a novel personal flotation device that does not require folding or repacking when deflated.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
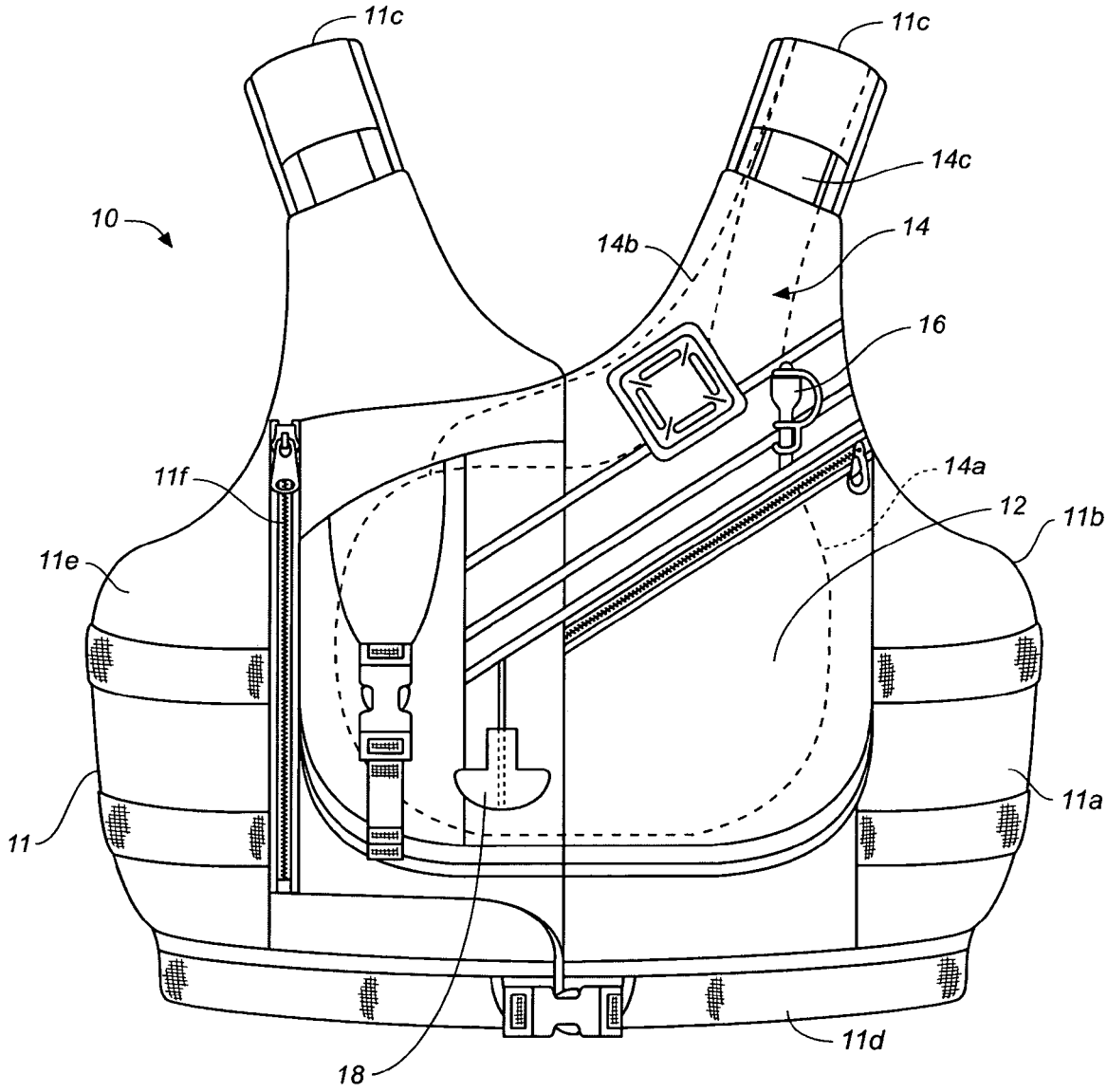
FIG. 1 is a front elevation view of an improved hybrid personal flotation device of this invention.

Referring to FIGS. 1 through 4, wherein like reference numerals refer to like components in the various views, there is illustrated therein a new and improved hybrid personal flotation device, generally denominated 10 herein.

FIG. 1 is a front elevation view of a first preferred embodiment of an inventive personal flotation device 10 of this invention. Flotation device 10 includes a more or less traditional flotation vest body 11 having a front 11*a*, back 11*b*, shoulder straps 11*c* connecting the front and back, and adjustable buckle straps 11*d* for securing the vest body around a wearer's torso, all as is well known in the art. Inherent buoyancy for the flotation device is provided by foam inserts 11*e*. One or more pockets 11*f* enable storage of small articles.

The inventive apparatus includes an expandable cover 12 over at least a portion of the vest body 11, covering an inflatable chamber 14 having a front chamber portion 14*a* connected to a back chamber portion 14*b* by a shoulder pass-through 14*c*. Inflation of the inflatable chamber 14 is accomplished by either or both of an oral inflation/deflation device 16 and a manual CO2 inflation pull tab 18.

Figure 2:
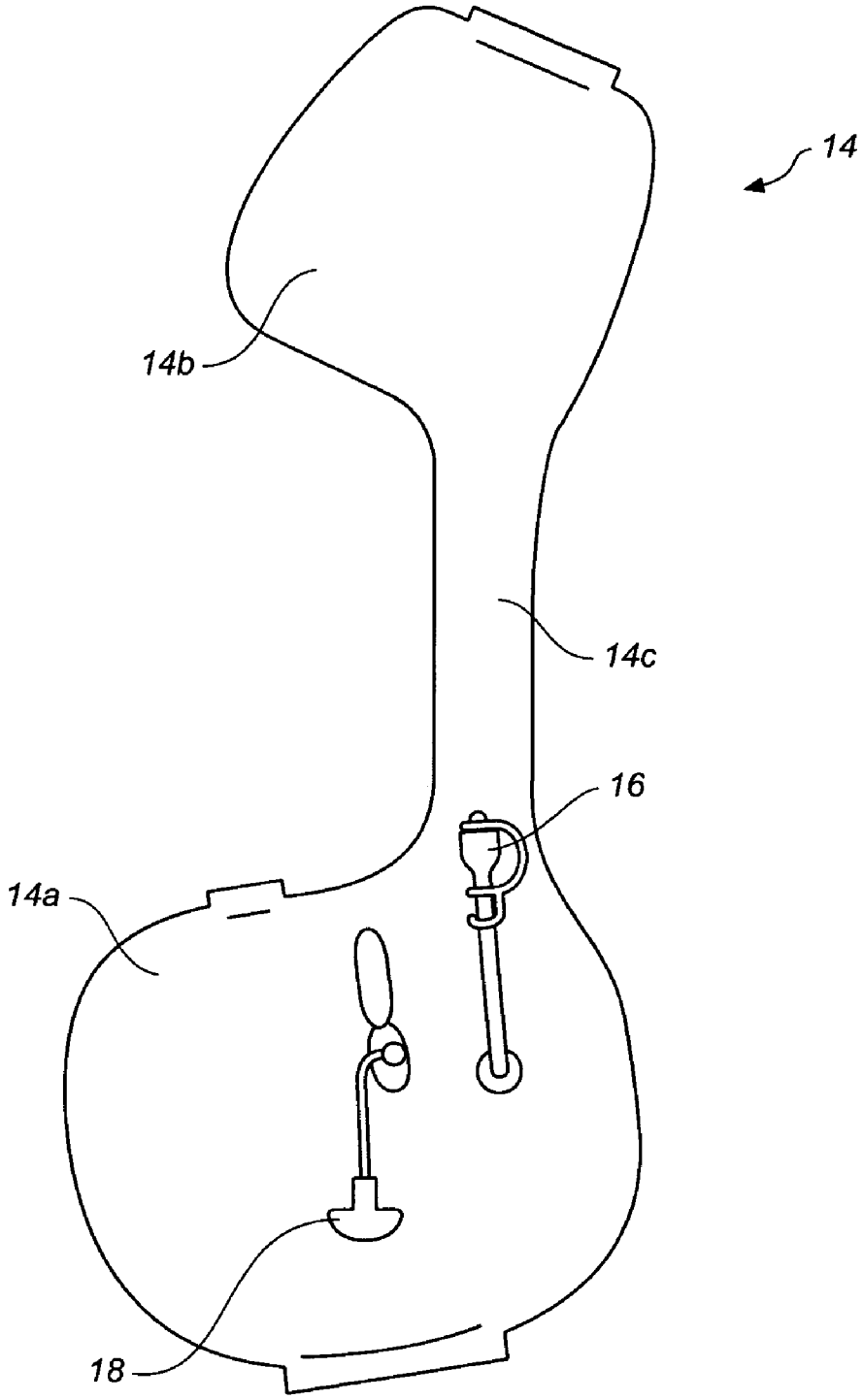
FIG. 2 is a plan view of the inflatable bladder or chamber portion of the inventive personal flotation device.

FIG. 2 is a plan view of the inflatable chamber portion 14 of the inventive personal flotation device. The low-profile, narrow single shoulder pass-through 14*c* permits fluid communication (for both inflation and deflation) between front chamber portion 14*a* and back chamber portion 14*b*, but does not restrict the wearer's neck or shoulder range of motion.

Figure 3:
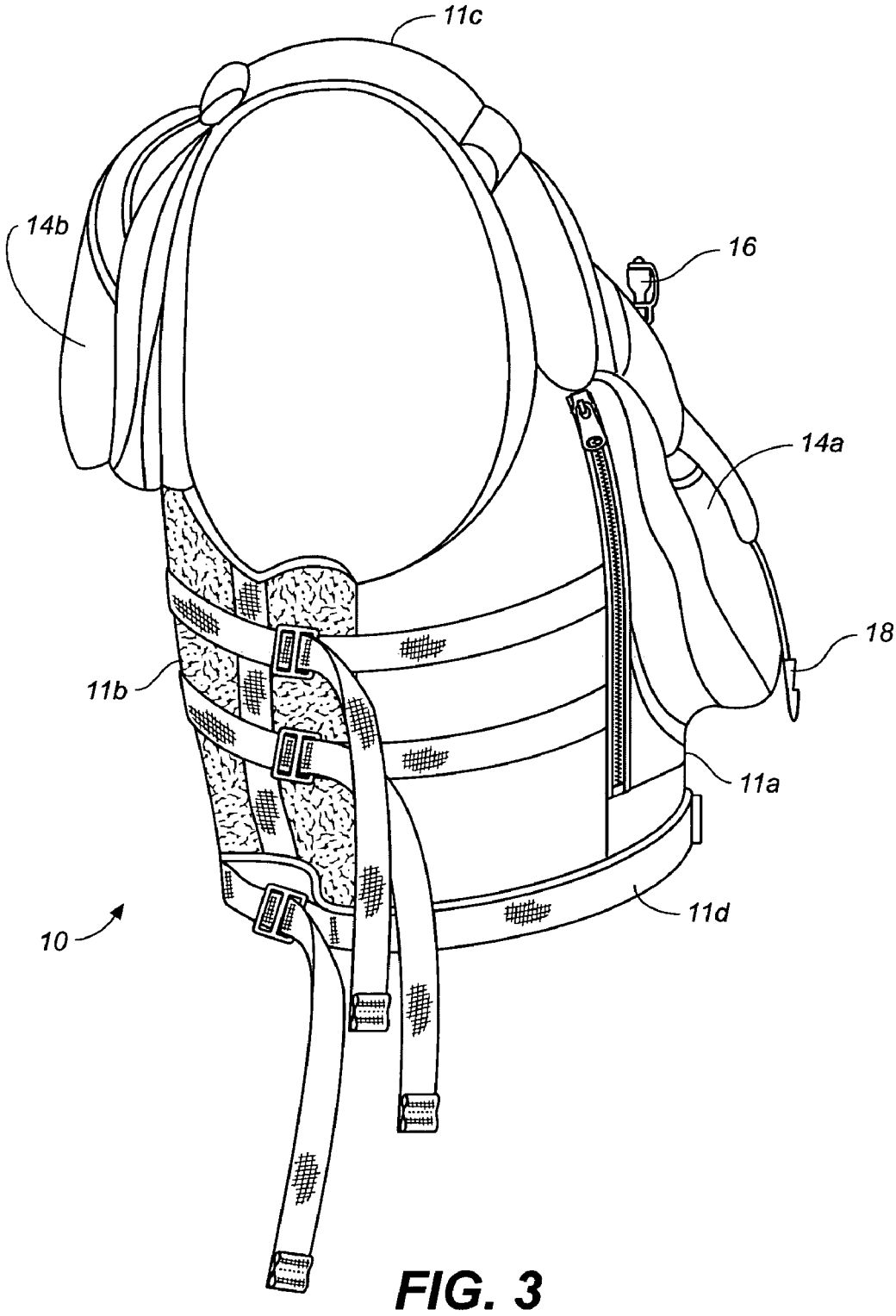
FIG. 3 is a right side elevation view of the personal flotation device of this invention with the inflatable chamber in its uninflated state.
Figure 4:
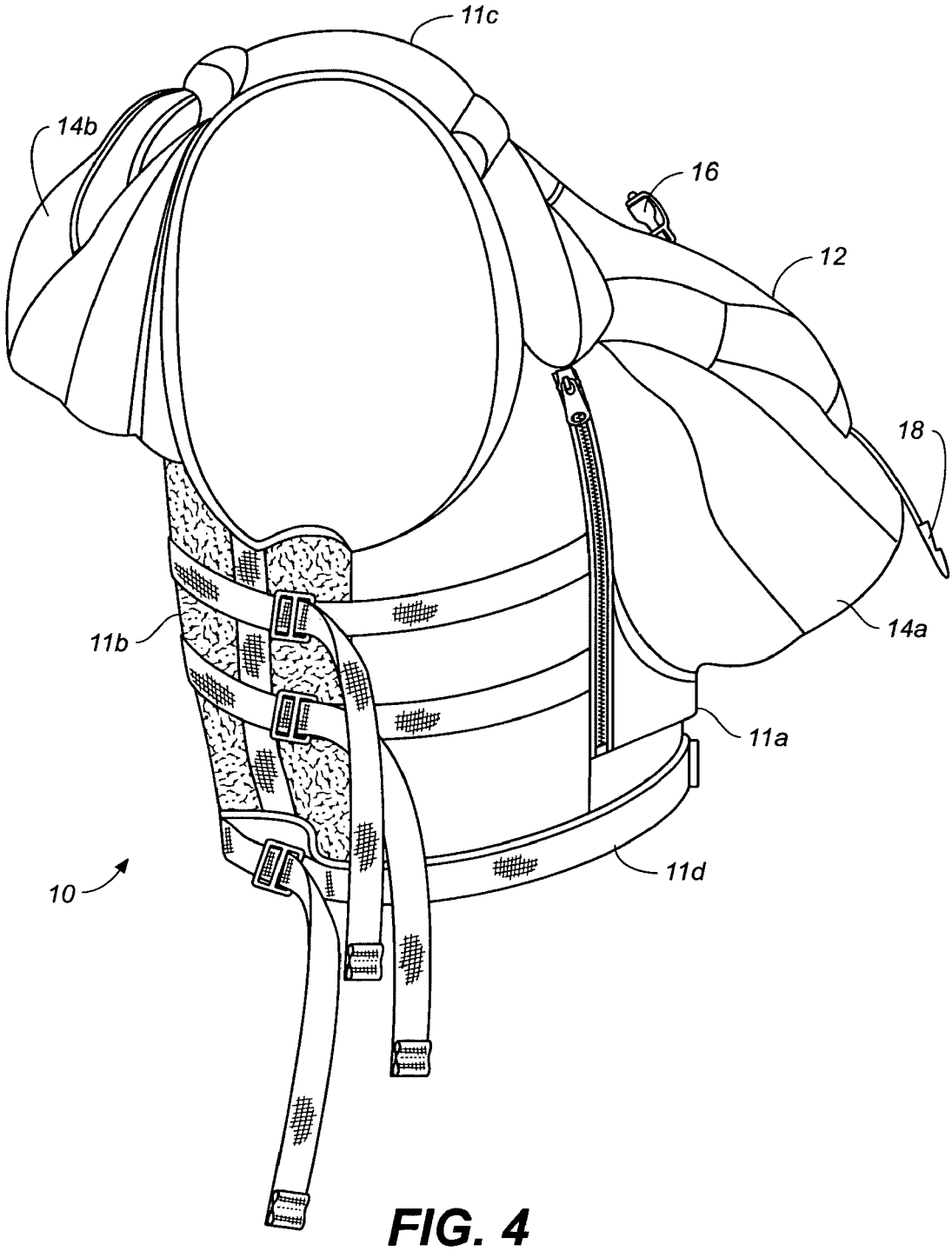
FIG. 4 is a right side elevation view of the personal flotation device with the inflatable chamber in its inflated state.

FIG. 3 is a right side elevation view of the personal flotation device 10 of this invention in its uninflated state, while FIG. 4 illustrates the device in its inflated state. These views illustrate that inflation causes expansion of front chamber portion 14*a* on the front 11*a* of the vest body 11, and expansion of back chamber portion 14*b* on the back 11*b* of vest body 11, but there is little or no expansion in the vicinity of shoulder straps 11*c*. The expandable cover 12 covers the front and back chamber portions in both their inflated and uninflated states.

The inventive apparatus thus solves the problem of user comfort and wearability by incorporation of distinct front and back chamber portions 14*a*, 14*b* connected by a single, minimal volume pass-through 14*c* that allows both chambers to be inflated using a simple inflation device. This places the inflated chambers lower on the wearer's body, freeing the wearer's neck and shoulder area from bulk, both of which make swimming in the inflated device simple and comfortable.

The inventive apparatus also solves the problem of reusability by placing each of the inflatable chamber portions 14*a*, 14*b* inside the self-adjusting expandable cover 12 that allows full inflation of the device when needed, while maintaining a closed configuration that requires no folding or re-packing when the device is subsequently deflated.

The inventive device may be constructed of commercially available fabrics, webbing, and hardware such as that listed in the UL Marine Products Directory, using common apparel and soft goods manufacturing machinery and techniques.

The inventive device may be used in recreational kayak/canoe touring, recreational sailing, whitewater kayak/canoe paddling, and other recreational boating and watersports activities.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

The invention claimed is:

1. A hybrid personal flotation device comprising:

a flotation vest body having a front, back, shoulder straps, and adjustable buckle straps;

an expandable cover over at least a portion of said vest body, said expandable cover portion covering an inflatable chamber having a front chamber portion connected to a back chamber portion by a single shoulder pass-through, wherein inflation of said inflatable chamber expands said front chamber portion on said front of said vest body, and expands said back chamber portion on said back of said vest body, but does not expand said single shoulder pass-through.

2. The hybrid personal flotation device of claim 1 wherein inflation of said inflatable chamber is accomplished by an oral inflation tube.

3. The hybrid personal flotation device of claim 1 wherein inflation of said inflatable chamber is accomplished by a manually activated cylinder containing compressed CO2.

4. The hybrid personal flotation device of claim 1 wherein said single shoulder pass-through permits fluid communication for inflation between said front chamber portion and said back chamber portion.

5. The hybrid personal flotation device of claim 1 wherein said single shoulder pass-through permits fluid communication for deflation between said front chamber portion and said back chamber portion.

6. The hybrid personal flotation device of claim 1 wherein said flotation vest body includes foam inserts to provide inherent buoyancy.

7. The hybrid personal flotation device of claim 1 wherein said expandable cover expands to cover said front chamber portion when inflated.

8. The hybrid personal flotation device of claim 1 wherein said expandable cover expands to cover said back chamber portion when inflated.

9. The hybrid personal flotation device of claim 1 wherein said flotation vest body includes at least one pocket for storage of small articles.

10. The hybrid personal flotation device of claim 1 wherein said expandable cover is self-adjusting to allow full inflation of said front chamber portion and said back chamber portion, while maintaining a closed configuration that requires no folding or re-packing upon subsequent deflation.

* * * * *